US005137098A

United States Patent [19]

Raffaelli

[11] Patent Number: 5,137,098

[45] Date of Patent: Aug. 11, 1992

[54] DIAMOND TOOL FOR DRILLING AND ROUTING

[75] Inventor: Dennis R. Raffaelli, Rochester Hills, Mich.

[73] Assignee: Inland Diamond Products Company, Madison Heights, Mich.

[21] Appl. No.: 754,237

[22] Filed: Aug. 26, 1991

Related U.S. Application Data

[63] Continuation of Ser. No. 479,838, Feb. 14, 1990, abandoned.

[51] Int. Cl.[5] ..... B23B 27/20; E21B 10/02; E21B 10/60

[52] U.S. Cl. ..... 175/403; 51/206 P; 175/434; 407/54; 408/27; 408/59; 408/203.5

[58] Field of Search ..... 175/330, 315, 403; 51/206 P, 206 R, 206.4, 72 R, 109 R; 407/42, 53, 54; 408/203.5, 145, 204, 26, 28, 27; 76/108.2

[56] References Cited

U.S. PATENT DOCUMENTS

| | | | |
|---|---|---|---|
| 2,182,562 | 12/1939 | Koebel | 175/330 |
| 2,996,061 | 8/1961 | Miller | 175/330 |
| 3,243,924 | 4/1966 | Peters | 408/204 |
| 3,495,359 | 2/1970 | Smith et al. | 175/330 |
| 4,274,769 | 6/1981 | Multakh | 408/204 |
| 4,757,645 | 7/1988 | Ozer et al. | 51/206 R |
| 4,776,862 | 10/1988 | Wiand | 51/309 |
| 4,854,788 | 8/1989 | Okinaga | 408/204 |

*Primary Examiner*—Stephen J. Novosad
*Attorney, Agent, or Firm*—Harness, Dickey & Pierce

[57] ABSTRACT

A diamond tool for combination drilling and routing. The tool has a shaft end and a cutting end with an aperture therein. The cutting end includes abrasive grit on the outer peripheral surface for routing purposes and has abrasive grit on the terminal end and the surfaces forming the aperture for drilling purposes.

6 Claims, 1 Drawing Sheet

DIAMOND TOOL FOR DRILLING AND ROUTING

This is a continuation of U.S. patent application Ser. No. 07/479,838, filed Feb. 14, 1990, now abandoned.

BACKGROUND

The present invention relates to a rotary cutting tool. More particularly, the present invention relates to a rotary tool for drilling or routing of hard materials such as marble, granite, stone or ceramics.

In the past, during cutting operations for forming internal shapes in marble panels or the like, there has been a need for drilling holes and cutting of contoured shapes, such as, for providing for a basin in a marble countertop. With the increased uses of granite, marble and the like materials today, the need for and utility of such tools has greatly increased.

The method for forming such shapes, in the past, has been to first drill a hole with a rotary or core drill in the marble or ceramic panel. Thereafter, the drill is replaced with a routing tool to cut the desired shape in the marble or ceramic sheet. In manufacturing operations such a two step process is costly due to the time requirements for changing tools and due to the requirement of having two types of cutting bits to keep in inventory for use.

These costs could be substantially reduced if a single tool could be utilized to effectively accomplish both drilling and routing functions. Such a tool is advantageously provided in the present invention.

SUMMARY OF THE INVENTION

According to the present invention there is provided a combination drilling and routing rotary tool. The rotary tool has a body portion which rotates symmetrically about a central axis and has a first shaft end and a second cutting end or it could be a double ended cutting tool. The shaft end is for engagement by a typical rotary tool drive. The cutting end generally includes a wall which defines an axially extending aperture therein during rotation thereof. The wall has an inner peripheral surface, an outer peripheral surface and a terminal end surface. The tool has at least a monolayer of a diamond-like hardness abrasive grit or other cutting means integrally attached to the terminal surface and extending axially along the inner peripheral surface and outer peripheral surface. The rotary tool of the present invention will penetrate a sheet of working material such as a marble or ceramic sheet in an axial direction and may then be used to cut in a radial direction laterally through the work piece.

Other features and advantages of the present invention, such as the use of polycrystalline diamond inserts, will be readily appreciated as same becomes better understood in light of the following description taken in connection with the accompanying drawings.

DESCRIPTION OF A PREFERRED EMBODIMENT

Figure 1:
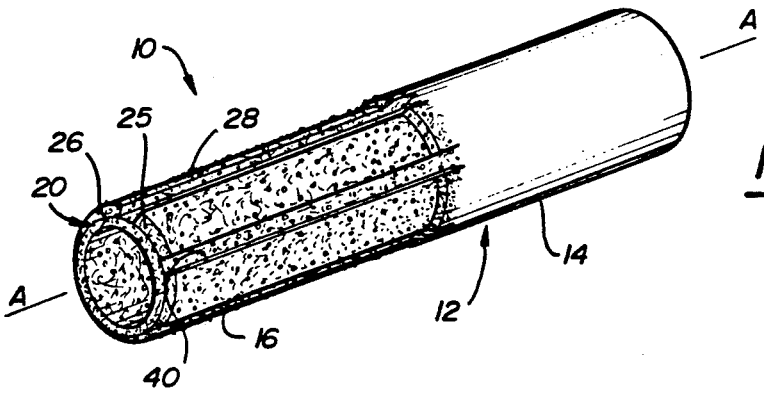
FIG. 1 is a perspective view of a rotary tool made in accordance with the teachings of the present invention.
Figure 2:
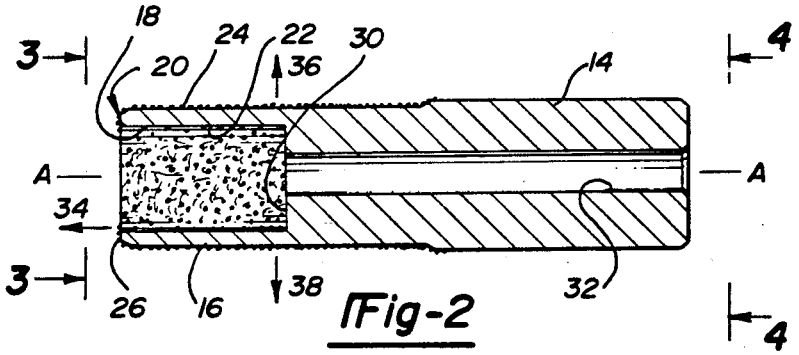
FIG. 2 is a cross-sectional view taken along line 2—2 of FIG. 1.

Referring now to the figures, in accordance with the present invention there is provided a combination drilling and routing rotary tool, generally shown at 10. The tool 10 of the present invention includes a body portion, generally indicated at 12, which is adapted such that it rotates symmetrically about a central rotational axis A. The body portion 12 includes at least a first shaft end 14 and at least a second cutting end 16.

The shaft end 14 of the present invention is of any suitable configuration for being engaged by a drill or routing rotary type tool. Thus, the cross-sectional shape of the shaft end 14 could be circular as shown in the drawings or hexagonal or other shape which would be compatible with such a tool.

The cutting end 16 of the tool of the present invention includes an axially symmetrical aperture 18 therein which is defined by the wall 20. The wall 20 includes an inner peripheral surface 22 and an outer peripheral surface 24. The cutting end 16 also includes a beveled surface 25 leading to a terminal end 26.

The cross-sectional shape of the cutting end 16 of the tool 10 can be provided in any number of shapes such as the cylindrical shape shown, provided the shape is symmetrical about an axis for rotation in a rotary tool drive.

The wall 20 must be of such a structural integrity that it can withstand sideways pressure upon routing operations with the tool. A central opening 32 is provided in the shaft end 14 to provide a means for introducing a coolant or lubricating fluid to the cutting end 16 during drilling or routing operations.

In a preferred embodiment, at least a monolayer of an abrasive grit 28 is integrally attached to the terminal end surface 26, axially along the inner peripheral surface 18 and axially along the outer peripheral surface 24. Preferably, the abrasive grit 28 is attached on the outer peripheral surface 24 axially toward the shaft end beyond the axial extent 30 of the aperture 18. This provides for increased structural stability when routing with the tool 10 after the hole drilling operation is complete. The tool 10 may be provided with axially extending grooves 40 formed in the outer peripheral surface for assisting in the cutting and routing functions and for assisting in flow of coolant or lubricant around tool 10 during cutting functions.

Of course, the necessary cutting surfaces may be provided by other abrasive or cutting means as will be readily recognized by those skilled in the art. For instance, a polycrystalline diamond insert could be fashioned to provide the abrasive surface at the terminal end surface 26. Similarly, a flycutter blade type arrangement could also be utilized for the hole cutter portion.

While many modes of attachment of an abrasive grit to the tool 10 may be utilized, in a preferred embodiment the abrasive grit material may be a monolayer of abrasive grit such as diamond particles brazedly attached to the tool by the methods set forth in my prior U.S. Pat. No. 4,776,862 entitled "Brazing of Diamond". If desired, a multi-layer type grit matrix could also be utilized in the present invention by the methods set forth in my U.S. patent application Ser. Nos. 310,783 entitled "Multi-Layer Abrading Tool and Process" and 326,152 entitled "Multi-Layer Abrading Tool Having an Irregular Abrading Surface and Process" which are now U.S. Pat. Nos. 4,908,046 and 4,945,686, respectively. The teachings of the above patents and patent applications are incorporated herein by reference.

In operation, the tool 10 of the present invention can be inserted into a conventional rotary tool and secured in the chuck thereof at the shaft end 14. Thereafter, the routing tool may be activated to provide rotation of the tool 10 about axis A. The tool 10 is moved axially, such as shown in the direction of arrow 34, into a work surface for drilling a hole in the surface. Thereafter, the tool may be actuated radially, such as shown by arrows 36 and 38, in any desired direction to produce an inside cutout shape in the work surface using the tool as a routing tool. This saves the step of having either two tools to provide this function or the problem of changing bits on a tool, thus saving man hours and cost.

In an alternate embodiment of the present invention the shaft end 14 may also be configured as with cutting end 16 to provide a second cutting and routing tool after the capabilities of the first cutting end are depleted during use.

Figure 5:
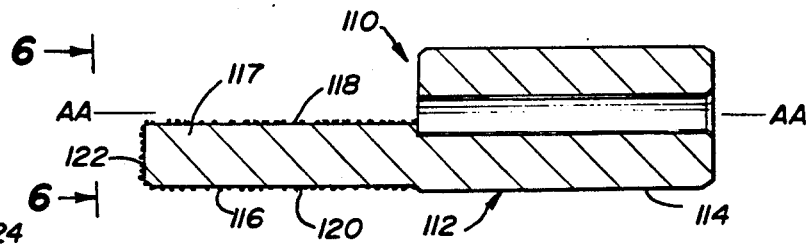
FIG. 5 shows a cross-sectional view of an alternate embodiment of a rotary tool having a non-symmetrically configured cutting surface which rotates symmetrically about the rotational axis.
Figure 3:
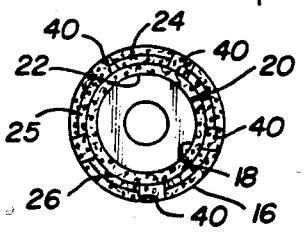
FIG. 3 is an end view of the rotary tool of FIG. 1 taken in the direction of arrows 3—3.
Figure 4:
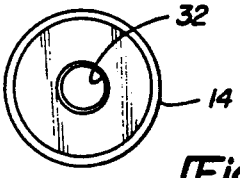
FIG. 4 is also an end view of the rotary tool of FIG. 1 taken in the direction of arrows 4—4.
Figure 6:
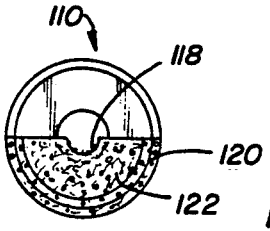
FIG. 6 is an end view of the rotary tool of FIG. 5 in the direction of arrows 6—6.

Referring now to FIGS. 5 and 6 there is shown an alternate embodiment of a drilling and routing tool 110. The tool 110 includes a body portion 112 and includes a cutting end 116 and a shaft end 114. The shaft end 114 is the same as shaft 14 disclosed above. However, in this embodiment the cutting end 116 is of a configuration wherein a leg portion 117 is formed having a semi-circular cross-sectional shape, best shown in FIG. 6. Accordingly, the tool 110 includes an inner abrasive grit covered semi-circular peripheral surface 118, an outer abrasive grit covered semi-circular peripheral surface 120 and an abrasive grit covered terminal surface 122 which are symmetrical when rotating about the axis AA. While a leg portion 117 is shown as having a semi-circular cross-section other cross-sectional configurations and even pluralities of legs could be utilized as will be appreciated by those skilled in the art, provided the configuration will drill and route by rotation about a single axis.

Thus, a tool made in accordance with the teachings of the tool of the present invention has all the advantages of diamond abrasive cutting technology, and is useful to drill and cut shapes in ceramics, marbles, glasses or other materials without the need of separate or special bits and the like.

While the above disclosure sets forth a preferred embodiment of the present invention it will be readily appreciated to those skilled in the art that the present invention may be subject to modification, variation and change without departing from the scope of the present invention. Accordingly, it is intended that the scope of the present invention be limited only by the following claims.

What is claimed is:

1. A combination drilling and routing rotary tool comprising:

a body portion rotating symmetrically about a central axis, said body portion providing at least one shaft end and one elongated cutting end, said shaft end for being engaged by a rotary tool drive, said elongated cutting end including a first axial bore cutting portion comprising: a structural wall for defining an axially extending aperture during rotation of said tool in said elongated cutting end, said well including at least a radially inner peripheral section of a surface, a radially outer peripheral section of a surface and a terminal end surface; a cutting means integral with said terminal end surface and said outer peripheral surface for cutting in an axial direction through a work piece; a second routing portion axially spaced from said first axial bore cutting portion, said second routing portion comprising a portion of said shaft portion beyond the axial extent of said aperture having increased structural stability when routing with the tool to withstand forces of radially directed routing, and at least a monolayer of abrasive grit brazedly attached axially along the length of said radially outer peripheral section and extending beyond the axial extent of said aperture for defining said second routing portion to withstand forces of radially directed routing through a work piece and that the tool may be utilized thereafter to route in said work piece in a radial direction.

2. The tool of claim 1 wherein said one cutting end further comprises a central opening in said shaft end for communicating with the axially extending aperture to provide a cooling and lubricating fluid to said cutting portion.

3. The tool of claim 1 further comprising a plurality of axially extending grooves along the outer peripheral surface of said wall.

4. The tool of claim 1 wherein at least said inner peripheral section of a surface, said outer peripheral section of a surface and said terminal end surface are continuous forming surfaces symmetrical about said axis.

5. A combination drilling and routing rotary tool comprising:

a body for rotation about an axis, said body portion having a shaft portion at a first end thereof and a second elongated cutting end, said second elongated cutting end including a first bore cutting portion having a second routing portion axially spaced from said first bore cutting portion, said first bore cutting portion including a first wall for defining an axially extending aperture during rotation of said tool, said wall including a terminal end having a means for cutting a bore in an axial direction through a work piece by rotation of the tool about the axis; and said wall including a radially inner surface and a radially outer surface;

an abrasive grit material attached to at least said radially outer surface and extending axially toward said shaft portion beyond the axial extent of said aperture, said second routing portion defined by the portion of said abrasive grit material extending beyond said aperture such that said shaft portion having at least a second thicker wall than said first wall for providing increased structural stability when using the second routing portion for routing with the tool in a radial direction through a work piece.

6. The tool of claim 5 wherein said wall is a section of a circle in cross-sectional shape.

* * * * *